United States Patent [19]

Adachi

[11] Patent Number: 4,591,155

[45] Date of Patent: May 27, 1986

[54] METHOD OF MAKING HOCKEY STICKS

[76] Inventor: Yutaka Adachi, 77 Saskatoon Dr., Weston, Ontario, Canada, M9P 2G1

[21] Appl. No.: 708,412

[22] Filed: Mar. 5, 1985

[51] Int. Cl.[4] ..... A63B 59/12; B65H 81/00

[52] U.S. Cl. ..... 273/67 A; 273/DIG. 7; 273/DIG. 23; 156/171; 156/245; 264/258

[58] Field of Search ..... 156/173, 171, 175, 188, 156/189, 190, 191, 192, 245; 273/67 A, DIG. 7, DIG. 23; 264/258

[56] References Cited

U.S. PATENT DOCUMENTS

| | | | |
|---|---|---|---|
| 3,489,412 | 1/1970 | Franck et al. | 273/DIG. 7 |
| 3,646,610 | 2/1972 | Jackson | 273/DIG. 7 |
| 4,148,482 | 4/1979 | Harwell, Jr. et al. | 273/67 A |
| 4,172,594 | 10/1979 | Diederich | 273/67 A |

*Primary Examiner*—Michael Ball
*Attorney, Agent, or Firm*—Donald E. Hewson

[57] ABSTRACT

A plastic hockey-stick is made in three layers, around a core. The blade-core is retained but the handle-core may either be retained or withdrawn during manufacture. The inner layer is of hoop-laid strands, which gives rigidity to the cross-sectional shape of the handle, enabling the handle to be hollow. The middle layer is of length-laid strands, for good bending strength. The outer layer is of e.g., twisted strand woven cloth, for surface toughness. The enwrapped core is impregnated with resin, and compressed in a mould during curing. The resulting stick combines lightness, strength, resilience, non-dangerous failure mode, and economy of manufacture.

14 Claims, 6 Drawing Figures

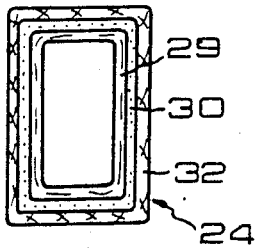
FIG2
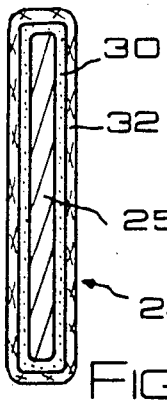
FIG3
FIG4
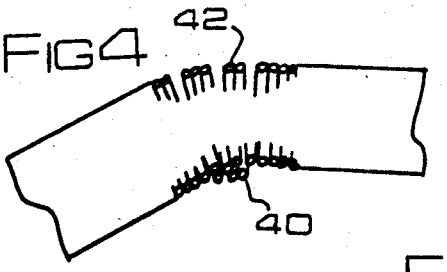
FIG5
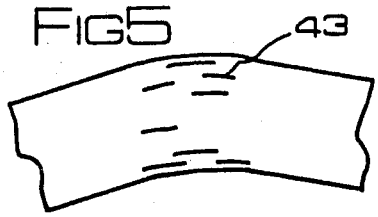
FIG6
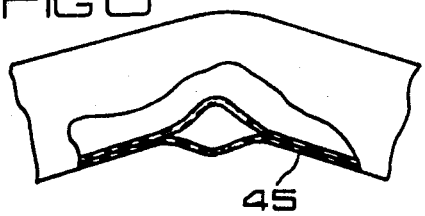

METHOD OF MAKING HOCKEY STICKS

This invention relates to the manufacture of ice-hockey sticks.

BACKGROUND OF THE INVENTION

Hockey sticks have generally been made of wood. The drawbacks to wood as a material are these: (a) wood is non-homogeneous, which means that the material has to be carefully inspected, which is expensive, to avoid weak spots in the stick; and (b) if a wooden stick should break, the splintered ends can be very dangerous.

On the other hand, a good wooden stick is amply strong enough. It possesses just the right qualities of resilience, lightness, and rigidity that players have come to require.

From the manufacturing standpoint, however, wood is an expensive material. If the stick can be made of plastic material, the stringent inspection and quality control could be much reduced. However, the manufacture of plastic sticks has only been possible hitherto if some aspects of the performance of the stick are compromised.

Potentially one of the more attractive aspects of making the stick in plastic is that the failure mode is to some extent controllable. When wood fails, it breaks. A plastic stick on the other hand, when it fails, still hangs together. Thus a plastic stick, when it failed, would simply have a bend in the wrong place, which is a much safer mode of failure than is possible with a wooden stick.

The level of abuse at which the plastic stick fails should be no less than that expected of a wooden stick. It is this strength requirement that has been the problem in previous plastic sticks.

The invention is aimed at providing a relatively inexpensive manner of manufacturing a plastic hockey stick, such that the stick thus produced will combine the qualities of strength, lightness, resilience, and rigidity to the required extent.

BRIEF DESCRIPTION OF THE INVENTION

The scope of the invention is defined in the accompanying claims, but briefly the invention lies in providing three layers of reinforcing strands in the plastic material.

In the first layer, the strands are wrapped, hoop-like, around the circumference of the stick. In the second layer, the strands are disposed along the length of the stick. In these two layers, the strands are as tightly packed together as can be achieved. The strands are not woven, which would tend to separate the strands.

In the third layer, however, the strands lie in different orientations. The third layer preferably comprises a layer (or layers) of twisted strand woven cloth, though woven roving, or chopped strand mat are inexpensive substitutes that are sometimes suitable.

The three layers each have their own individual purposes. The first layer—the hoop-laid strands—gives the handle of the stick the strength it needs against forces tending to distort the cross-sectional shape of the handle. Thus the handle can be hollow without undue loss of strength.

The second layer—the length-laid strands—gives the handle its strength against bending forces.

The third layer—the multi-orientated strands—gives the outer surface of the stick its strength to resist impacts, and its resistance to wear generally.

In addition to their individual purposes, the layers also complement each other. When the stick is subject to bending stresses, one side of the stick is in compression. With hoop-laid stands, there can be a tendency for adjacent strands on the compression side to ride up over each other at quite low bending stresses (the plastic or resin material being much weaker than the strands). The length-laid strands however, being adjacent to the hoop-laid strands, help the plastic material to resist this tendency. Riding up of the hoop-laid strands, because of the presence in the invention of the length laid strands, does not occur until much higher stress levels.

Similarly, it can happen that length-laid strands can tend to slip over each other. During bending, the extreme strands have to stretch more than the not-so-extreme strands; the resulting slippage, if it occurs, resembles a de-lamination of the stick. The hoop-laid strands bind the length-laid strands together, and again this kind of failure does not occur until much higher stress levels are reached.

A third possible kind of failure is that the length laid strands that are in compression due to bending might fail by buckling. When the length-laid strands are in the middle layer of three layers, the two outer layers can resist any tendency of the length-laid strands to buckle, either outwards or inwards.

Hence, in a number of ways, each of the layers complements the other lays in giving the stick a greater resistance to various kinds of failures than would be expected.

Under abusive conditions, the stresses do not neatly fall into these mathematical categories of course, but are spurious combinations of crushing, bending, transverse shear, torsion, and impact stresses. Disposing the strands as described in the invention has the effect of increasing the toughness of the stick in coping with stresses in any category.

The blade portion of the stick may have a core of solid material, and the loop-laid first layer may be omitted in the blade portion; the core would then be arranged to provide the cross-sectional strength and rigidity that the blade needs. The other two layers should be retained over the blade portion, since the length-laid strands provide needed bending strength, and the multi-orientated strands provide the surface toughness that the blade especially needs.

The handle portion may retain its core, or the core may be a removable mandrel that is withdrawn from the handle at a later stage of manufacture. If retained, the core may be of soft, very light, material since the core need not contribute to the cross-sectional strength and rigidity of the handle. A hollow handle, or a handle with a soft core, might appear to be vulnerable to collapsing due to a crushing type of stress, but the hoop-laid layer provides good resistance to such stresses. The need in the handle for a strong, and therefore heavy, core is thus avoided.

BRIEF DESCRIPTION OF THE DRAWING

FIG. 2 is a cross-section on line 2—2;

FIG. 3 is a cross-section on line 3—3;

FIGS. 4, 5 and 6 are generally schematic sketches showing different modes of failure of hockey sticks.

DETAILED DESCRIPTION OF PREFERRED EMBODIMENT

Figure 1:
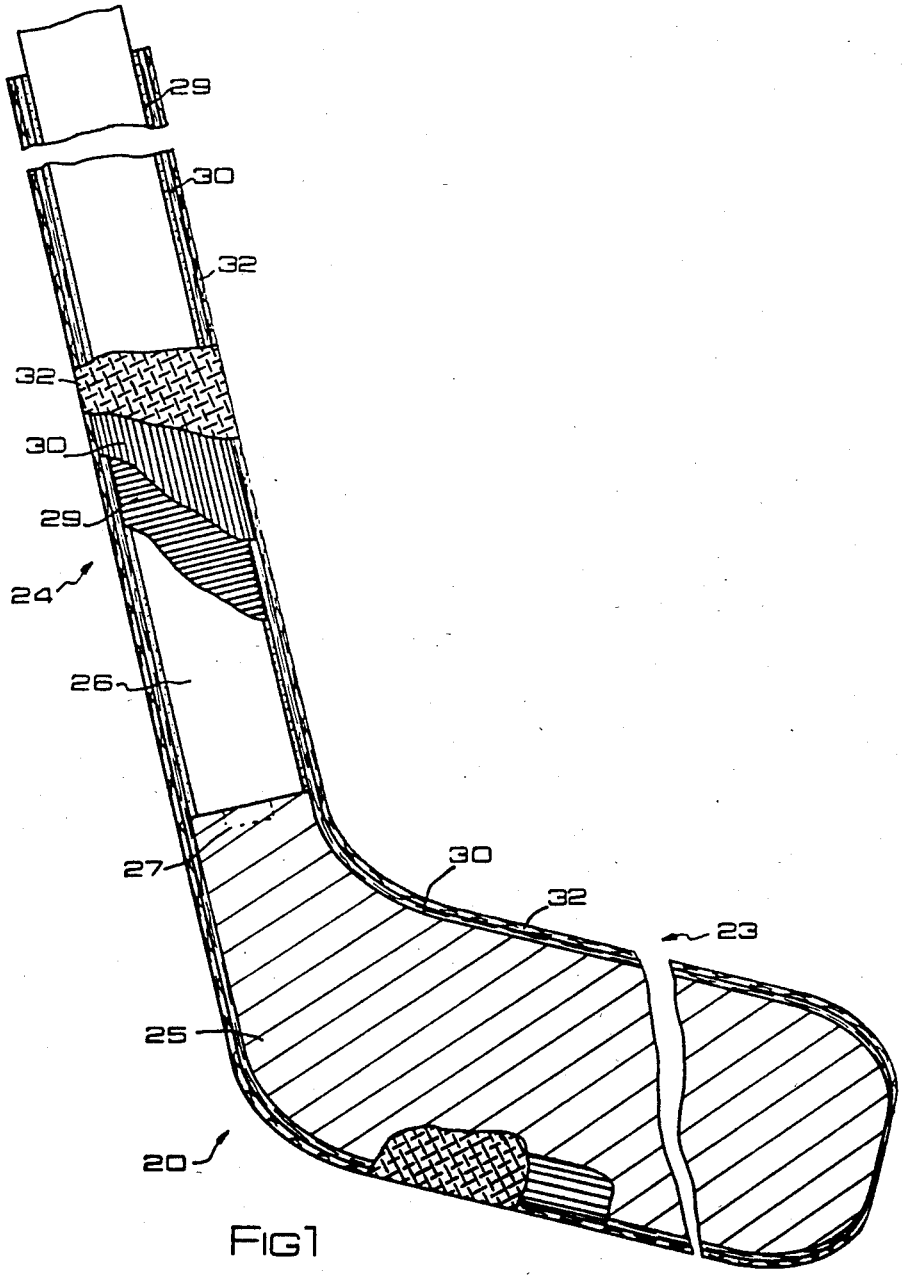
FIG. 1 is a cross-sectional view of a hockey stick made according to the invention.

The hockey-stick 20 shown in the drawings comprises a blade-portion 23 and a handle-portion 24.

The blade-portion 23 includes a core 25. The handle-portion 24 includes a core in the form of a mandrel 26 which is arranged so that it can be withdrawn later from the handle 24 of the hockey-stick 20. The mandrel 26 is spigoted to the blade-core 25 at 27 for accurate location. The blade-core 25 might be made of wood, but preferably it is made of plastic foam, which absorbs the liquid resin. Wood might retain moisture, which would cause separation of the resin from the wood. Also, if the stick were to be abraded to such an extent that the wood was exposed, then water would soak into the wood, with the same result.

A first layer 29 of reinforcing strands is wrapped around the mandrel 26. The first layer 29 does not extend into the blade-portion 23. The strands are wound helically onto the mandrel 26, and are packed tightly together.

In a second layer 30, the reinforcing strands are laid lengthwise along the mandrel 26, and extend down over the blade-core 25. Again, the strands are packed tightly together. The strands may be of carbon fibre or of glass fibre, or a mixture of the two. Carbon is more expensive, but is stronger and more rigid. Glass however gives more resilience. The ratio can be varied according to the criteria of cost, stiffness, and strength.

Three kinds of mats of reinforcing strands can be used in the third layer 32. The first kind is chopped strand mat. This is an inexpensive material. The second kind of mat, is called woven roving. The strands themselves are plain. This mat is more expensive than the chopped strand mat, but it gives a superior toughness and finish to the moulded stick. The third kind is twisted strand woven cloth, where the woven strands are not themselves plain but are helically twisted. This is more expensive again, but is correspondingly superior as regards the toughness and finish of the outer layer of the stick. The third layer 32 covers the whole stick, blade and handle together. The third layer may be three or four mats thick, whether the strands are of the woven or random-orientated kind, especially over the lower edge of the blade which receives the greatest wear.

The enwrapped cores are impregnated with plastic resin in liquid form. The mandrel 26 is coated with a release agent to allow it to be withdrawn later, and is slightly tapered for the same reason. The soaked stick is compressed in a press to force the resin into all the interstices between the strands.

The moulds of the press are arranged to have a complementary shape to that of the finished stick. Thus, as shown in FIG. 2, the corners of the cross-sectional shape of the stick can be moulded into the small radius that hockey sticks normally have. This small radius may be contrasted with the unacceptably large radius that results when the stick is manufactured by simply wrapping strands around a core, without moulding them in a press.

The mould part-line may be arranged in any convenient plane. The moulds may take the form, for instance, one of a channel into which the enwrapped core is placed, the other of a plug which enters the channel after the core and squeezes the core into the channel.

As mentioned above, over the bottom edge of the blade 23 the third layer 32 should be several mats thick. However, there is no real need for many mat thicknesses in other parts of the stick. When the stick is moulded, it is an easy matter to arrange that strips of woven roving can be arranged to lie along, and straddle, the edge. This may be compared with the difficulty of increasing the layer thickness locally if the stick were just enwrapped, and not pressed in a mould.

FIG. 4 shows a stick which is wrapped with hoop-laid reinforcing strands, and which has failed. As may be seen, the strands 40 on the compression side are over-ridden, whereas the strands 42 on the tension side have parted.

FIG. 5 shows another stick that has failed. Here, the strands are length-laid, and have slipped relatively, leading to the de-lamination 43.

The presence of the length-laid and the hoop-laid strands together, in the invention, increases the stress-level at which either of these two failures can occur, to a level well beyond that at which a wooden stick would be expected to break. It will be noted that when eiher of the above failures takes place, many of the reinforcing strands remain unbroken; it is thus virtually impossible for the broken pieces to become separated.

A failure of the stick may take the form of buckling on the compressive side of the stick as shown in FIG. 6. The compressed fibres 45 may buckle either outwards or, because the stick is hollow, inwards. The length-laid strands in the middle layer 30 have little resistance themselves to buckling, but are constrained by the presence of the other two layers 29,32.

It is mainly the lower part of the handle of a hockey stick that is prone to breakage. The layers as described therefore need not extend right to the top of the handle.

I claim:

1. A hockey stick having a handle portion and a blade portion;

where the cross-sectional profile of the handle is different from the cross-sectional profile of the blade both in breadth and thickness;

and having a transition portion whose cross-sectional profile changes smoothly and progressively from the profile of the handle to that of the blade;

where at least the handle portion is formed of at least three layers, the innermost of which comprises a plurality of strands which are disposed circumferentially around the profile and are packed closely together and parallel to each other;

the middle layer having a plurality of strands packed closely together and parallel to each other, and disposed lengthwise along said handle portion;

the outer layer having adjacent strands disposed in different directions to each other;

and where similar structures as to the second and third layers are also present over a core in the blade and transition portion of the hockey stick;

the second and third layers of said handle portion extending downwardly to said transition portion and forming a portion of the same layers thereof;

and where the fibres of said layers on said handle, blade and transition portions have been impregnated with a resin which has been permitted to cure while being compressed in a mould which defines the shape of the entire stick;

so that said hockey stick is integrally formed.

2. The hockey stick of claim 1, where said handle portion has been formed over a core which has subsequently been removed after curing.

3. The hockey stick of claim 1, where said handle portion includes a core over which said portion has been formed and cured.

4. The hockey stick of claim 1, where in the third layer the strands are woven.

5. The hockey stick of claim 1, where the strands of said second layer entered uninterrupted from said handle portion over at least said transition portion.

6. The hockey stick of claim 1, where the strands of the first layer are formed from a filament wound helically around the core.

7. The hockey stick of claim 1, where said first layer comprises many separate strands, each strand having a length equal to a little more than the circumference of said handle portion.

8. Method of making a hockey stick having a handle portion, and a blade portion, comprising the steps:

of providing a core for said handle portion and a separate core for said blade portion;

of enwrapping the core in a mat of fibres or strands;

where the mat is arranged in first, second and third layers in said handle portion and second and third layers in the said blade portion;

where, in the first layers, the strands are:

(a) packed tightly together;

(b) parallel to each other;

(c) touching each other along the lengths of the strands;

(d) disposed around the circumference of the core of said handle portion;

where, in the second layer for said handle and blade portions, the strands are:

(a) packed tightly together;

(b) parallel to each other;

(c) touching each other along the lengths of the strands;

(d) disposed along the length of the core of said handle portion and along the length of said core of said blade portion, where the strands of the second layer of said handle portion extend over at least a portion of the core of said blade portion;

where, in the third layer, adjacent strands are disposed in different directions to each other and cover the handle and blade portions of said hockey stick;

where the layers are arranged one inside the other with the first layer innermost and the third layer outermost, and each layer extends without interruption along at least a portion of the length of the core of said handle portion, and substantially completely around the circumference of the core; and each of the second and third layers of said handle portion extends along at least a portion of the length of said blade portion and around the circumference thereof;

followed by the further steps:

of impregnating the mat with resin;

of compressing in a press with impregnated mat onto the cores of said handle and blade portions, between moulds that define the shape of the integrally formed stick;

and of holding the mat compressed while the resin cures.

9. Method of claim 8, where in the third layer the strands are woven.

10. Method of claim 1, where the core remains with the blade portion in the finished stick.

11. Method of claim 1, where the core in the handle portion is in the form of a mandrel, and where the method includes the further step of removing the mandrel from the stick, the handle portion thereby being of hollow form.

12. Method of claim 10, where the strands of the second layer extend without interruption over the transition from the handle portion to the blade portion.

13. Method of claim 8, where the strands of the first layer are formed from a filament wound helically around the core.

14. Method of claim 8, where the first layer comprises many separate strands, each strand having a length equal to a little more than the circumference of the core.

* * * * *